US012560340B2

(12) United States Patent
Mastromonaco et al.

(10) Patent No.: US 12,560,340 B2
(45) Date of Patent: Feb. 24, 2026

(54) AIR-MIXING PLENUM AND METHOD OF MIXING FLOWS OF AIR THEREWITH

(71) Applicant: INGENIA TECHNOLOGIES INC., Mirabel (CA)

(72) Inventors: George Mastromonaco, Mirabel (CA); David Guevremont, Mirabel (CA); Pierre Chauvat, Mirabel (CA)

(73) Assignee: Ingénia Technologies Inc., Mirabel (CA)

( * ) Notice: Subject to any disclaimer, the term of this patent is extended or adjusted under 35 U.S.C. 154(b) by 93 days.

(21) Appl. No.: 18/517,108

(22) Filed: Nov. 22, 2023

(65) Prior Publication Data

US 2024/0167702 A1 May 23, 2024

Related U.S. Application Data

(60) Provisional application No. 63/384,647, filed on Nov. 22, 2022.

(51) Int. Cl.

| | |
|---|---|
| ***F24F 3/052*** | (2006.01) |
| ***F24F 13/02*** | (2006.01) |
| ***F24F 13/04*** | (2006.01) |
| *F24F 13/08* | (2006.01) |

(52) U.S. Cl.
CPC ..... *F24F 3/052* (2013.01); *F24F 13/0263* (2013.01); *F24F 13/04* (2013.01); *F24F 13/085* (2013.01)

(58) Field of Classification Search
CPC ..... F24F 3/052; F24F 3/0522; F24F 13/04
See application file for complete search history.

(56) References Cited

U.S. PATENT DOCUMENTS

| | | | | |
|---|---|---|---|---|
| 3,911,804 A * | 10/1975 | Tao | F24F 13/04 137/896 |
| 6,213,867 B1 * | 4/2001 | Yazici | F24F 1/01 454/263 |
| 2005/0056313 A1 * | 3/2005 | Hagen | B01F 25/3132 137/3 |
| 2017/0153039 A1 * | 6/2017 | Dorste | F24F 11/46 |

* cited by examiner

*Primary Examiner* — Jonathan Bradford
(74) *Attorney, Agent, or Firm* — Husch Blackwell LLP

(57) ABSTRACT

A mixing plenum having at least one mixing column configured to be disposed in a first flow of air, the mixing column comprising an elongated body defining a channel extending along a longitudinal axis of said elongated body, the elongated body comprising at least one perforated surface, the at least one perforated surface forming an angle with a flow direction of the first flow of air, wherein the channel is adapted to receive a second flow of air, the mixing column being configured to generate a mixture of the first and second flows of air across the at least one perforated surface.

20 Claims, 8 Drawing Sheets

AIR-MIXING PLENUM AND METHOD OF MIXING FLOWS OF AIR THEREWITH

FIELD OF THE INVENTION

The present invention relates to the field of ventilation and air conditioning systems. More particularly, the present invention relates to a new air-mixing assembly, and also relates to a system (ex. ventilation system, air conditioning system, etc.) provided with such an air-mixing assembly, as well as to a kit with corresponding components for assembling the same, and to corresponding methods of manufacturing, assembling and/or operating associated thereto.

BACKGROUND

Devices used for conditioning (ex. dehumidifying, etc.) air, such as air-mixers, for example, are well known in the art.

It is also known that there is a need to find a solution to the problem generated by the mixing of multiple air streams at different temperatures in heating, ventilation and air conditioning systems. Indeed, ventilation systems frequently use outdoor air to supply the building they serve. To limit the energy consumption, it is frequent to mix this air with the return air from the building. However, when the air is cold, the temperature can drop below the freezing point and cause problems. Equipment such as water coils downstream of the mixed-air streams present a risk of freezing, which results in costly repairs to the system and the building. In addition, a more homogeneous flow allows a better operation of the ventilation unit. It is necessary to perfectly control the two (2) air flows that take place in the mixing section of the ventilation unit. It would thus be very useful to provide a new equipment, which creates the air-mixing section.

Currently, several solutions exist to resolve this problem. The simplest and most common design consists of not adding any mixing equipment to protect the equipment against freezing. This solution is acceptable when the temperatures are not below the freezing point or very close to the freezing point. Similarly, it is also possible to add glycol to the water system to protect from freezing. The quantity of glycol can be adjusted depending on the lowest expected temperature. On the other hand, the addition of glycol in a water circuit greatly reduces the thermal performance of the heat transfer coil.

Another alternative is to add an air mixing device downstream of the mixing section. The purpose of the latter is to break the stratification of the air by agitating it in multiple directions. Thus, the two flows mix reducing the extreme temperatures. However, this solution requires a latent zone after the mixing section to allow the air agitation to work. This means that there is more space to consider for this type of solution resulting in additional costs. Also, the dimensional constraints of the units do not always allow to increase the length of the latter. The mixtures have good performance but are generally difficult to manufacture and costly.

Finally, yet another alternative consists in an active control of the flows in order to mix the air streams. Concretely, this solution is installed in the mixing box and has several channels. Each air channel has an air flap to control the air passing through it. Although this allows good performance and reduced section length, it increases the complexity of the system. The associated costs are increased as well as the necessary maintenance.

In view of the above and other considerations, there is always a need to continue innovating and finding better and/or different ways of processing (ex. mixing, drying, conditioning, purifying, heating/cooling, etc.) air (ex. ambient air inside a building, etc.) and/or a corresponding airflow thereof, and to be able do so, in a quicker, easier, simpler, faster, more efficient, more convenient, more reliable, more versatile, more environment-friendly, more sustainable and/or more desirable manner.

Therefore, it would be particularly useful to be able to provide an improved air-mixing assembly which would be able to overcome or at the very least minimize some of known drawbacks associated with conventional ways and devices used for conditioning air, for example.

SUMMARY OF THE INVENTION

An object of the present invention is to provide an air-mixing assembly which, by virtue of its design and components, would be an improvement over other related conventional air-mixing devices, methods and/or the like known in the prior art.

In accordance with the present invention, the above object is achieved, as will be easily understood from the present description, with an air-mixing device (also referred to herein simply as air-mixing "column", air-mixing "plenum" (or simply "mixing plenum") and/or air-mixing "assembly" such as the one briefly described herein and such as the one exemplified in the accompanying drawing(s). Furthermore, and in the context of the present description, the present air-mixing system (and/or various aspects and/or components thereof, etc.) may be referred to also as "EcoMix", which is one possible trademark expression contemplated, used and/or owned by the Applicant/Assignee of the present application.

According to yet another aspect of the present invention, there is also provided an air-mixing plenum provided with the above-mentioned air-mixing column and/or assembly.

According to yet another aspect of the invention, there is also provided a system provided with the above-mentioned air-mixing column, plenum and/or assembly.

According to yet another aspect of the invention, there is also provided a method of manufacturing components of the above-mentioned air-mixing column, plenum, assembly, and/or system.

According to yet another aspect of the invention, there is also provided a method of assembling components of the above-mentioned air-mixing column, plenum, assembly, and/or system.

According to yet another aspect of the invention, there is also provided a method of using the above-mentioned air-mixing column, plenum, assembly, cartridge, system and/or component(s) thereof.

According to yet another aspect of the invention, there is also provided a kit with components for assembling the above-mentioned air-mixing column, plenum, assembly and/or system.

According to yet another aspect of the present invention, there is also provided a set of components for interchanging with components of the above-mentioned kit.

According to yet another aspect of the present invention, there is also provided a method of assembling components of the above-mentioned kit and/or set.

According to yet another aspect of the present invention, there is also provided a method of processing (ex. mixing, etc.) air with the above-mentioned air-mixing column, plenum, assembly, system, component(s) thereof, kit, set and/or method(s).

According to yet another aspect of the present invention, there is also provided a method of doing business with the air-mixing column, plenum, assembly, system, component(s) thereof, kit, set and/or method(s).

According to yet another aspect of the present invention, there is also provided a mixing plenum comprising at least one mixing column configured to be disposed in a first flow of air, the mixing column comprising an elongated body defining a channel extending along a longitudinal axis of said elongated body, the elongated body comprising at least one perforated surface, the at least one perforated surface forming an angle with a flow direction of the first flow of air, wherein the channel is adapted to receive a second flow of air, the mixing column being configured to generate a mixture of the first and second flows of air across the at least one perforated surface.

In accordance with some embodiments, the elongated body of the at least one mixing column and a first neighbouring surface of the elongated body define a plenum inlet therebetween adapted to receive the first flow of air.

In accordance with some embodiments, the elongated body of the at least one mixing column and a second neighbouring surface of the elongated body define a plenum outlet therebetween adapted to exhaust one of a portion of the first flow of air, and the mixture of the first and second flows of air.

In accordance with some embodiments, a surface area of the plenum outlet is greater than a surface area of the plenum inlet.

In accordance with some embodiments, the mixing column comprises a brim portion extending from a first end of the elongated body.

In accordance with some embodiments, the at least one perforated surface and the brim portion define at least a portion of a second channel extending from the plenum inlet to the plenum outlet, the second channel being adapted to receive the first flow of air.

In accordance with some embodiments, the at least one perforated surface is angled outwardly with respect to the flow direction of the first flow of air to define an acute angle with respect to the flow direction of the first flow of air.

In accordance with some embodiments, the perforated surface comprises a downstream portion defined at a distal end of the perforated surface along the first flow of air, the downstream portion of the perforated surface being devoid of perforations.

In accordance with some embodiments, at least a portion of the mixing plenum is coated in a thermal insulating coating to maintain a temperature of the elongated body above a dew point of the first and second flows of air.

In accordance with some embodiments, the thermal insulating coating comprises high-density polyethylene.

In accordance with some embodiments, the perforated surface defines a plurality of air flow perforations, and wherein a surface area of the respective air flow perforations increases along a flow direction of the second flow of air.

In accordance with some embodiments, the mixing plenum defines a bypass conduit comprising a bypass inlet disposed in the first flow of air, the bypass channel extending around the mixing column and being configured to selectively receive the first flow of air.

In accordance with some embodiments, the mixing plenum further comprises a frame adapted to receive a plurality of mixing columns, the plurality mixing columns being aligned in an adjacent configuration in a direction being normal to the flow direction of the first flow of air.

In accordance with some embodiments, the elongated body comprises a closed end configured to restrict a flow of the second flow of air, the channel of the elongated body being configured to direct an entirety of the second flow of air to the perforated surface.

In accordance with some embodiments, the elongated body comprises a trapezoidal transverse cross-sectional shape.

According to yet another aspect of the present invention, there is also provided a method of mixing first and second flows of air having different temperatures, the method comprising exposing an air-mixing column of an air-mixing plenum to the first flow of air, the first flow of air defining a first flow direction, channeling the second flow of air through a channel extending through the air-mixing column along a longitudinal axis thereof, channeling the first flow of air along a perforated surface of the air-mixing column, the perforated surface forming an angle with the first flow direction, and forming a pressure differential across the perforated surface to generate a mixture of the first and second flows of air.

In accordance with some embodiments, the method further comprises exhausting the mixture of the first and second flows of air out of the air-mixing plenum in the first flow direction.

In accordance with some embodiments, the method further comprises operating a damper to selectively regulate a volumetric flow rate of the second flow of air.

In accordance with some embodiments, the method further comprises operating the damper to form a mixture ratio of the first and second flows of air comprising less than 20% of the second flow of air.

In accordance with some embodiments, the method further comprises thermally insulating at least a portion of the air-mixing plenum to maintain a temperature of the surface of the air-mixing plenum above a dew point of the first and second flows of air.

The objects, advantages, and other features of the present invention will become more apparent upon reading of the following non-restrictive description of preferred embodiments thereof, given for the purpose of exemplification only, with reference to the accompanying drawing(s).

DETAILED DESCRIPTION OF PREFERRED EMBODIMENTS OF THE INVENTION

Figure 1:
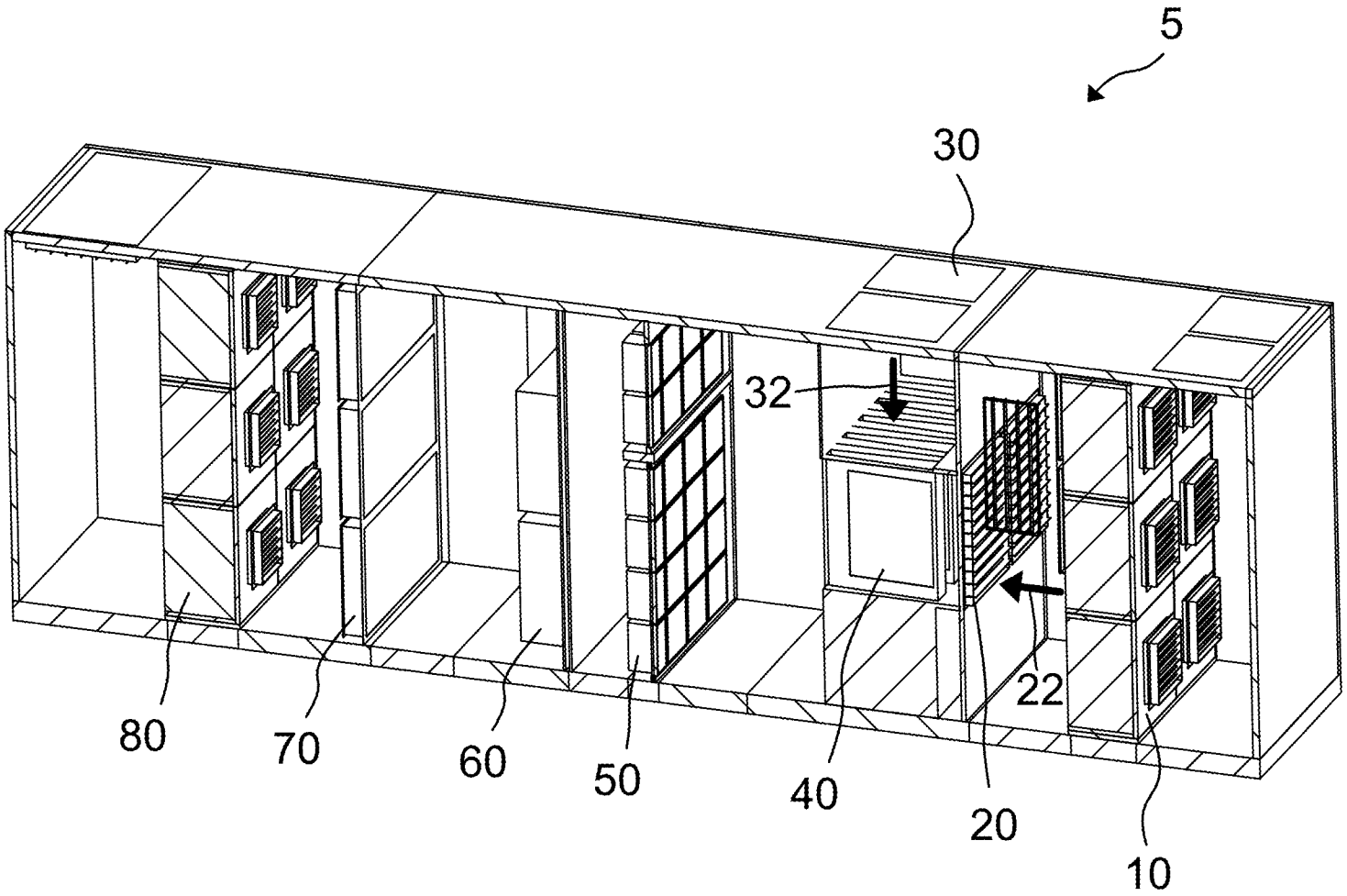
FIG. 1 is a top perspective view of an air handling unit including an air-mixing plenum, in accordance with an embodiment.

In the following description, the same numerical references refer to similar elements. Furthermore, for sake of simplicity and clarity, namely so as to not unduly burden the figures with several reference numbers, only some figures have been provided with reference numbers, and components and features of the present invention illustrated in other figures can be easily inferred therefrom. The embodiments, geometrical configurations, materials mentioned and/or dimensions shown in the figures are preferred, for exemplification purposes only.

Moreover, although the present invention was primarily designed for processing (ex. mixing, conditioning, drying, dehumidifying, etc.) air, for example, it may be used with other objects and/or in other types of applications, as apparent to a person skilled in the art. For this reason, expressions such as "processing", "mixing", "conditioning", "drying", "dehumidifying", "air", etc., used herein should not be taken so as to limit the scope of the present invention and include all other kinds of objects and/or applications with which the present invention could be used and may be useful. For example, the present air-mixing plenum assembly (ex. air-mixing column, air-mixing plenum, etc.) could also be used for "cooling" and/or "heating" purposes, by respectively "reducing" and/or "increasing" relative humidity of air being treated with the present system via an appropriate mixing of air flow(s), etc., as can be easily understood by a person skilled in the art.

Moreover, in the context of the present invention, the expressions "air-mixing", "column", "plenum", "assembly", "mixer", "product", "system", "device", "apparatus", "unit", "equipment", "tool", "method" and "kit", as well as any other equivalent expression(s) and/or compound word(s) thereof known in the art will be used interchangeably, as apparent to a person skilled in the art. This applies also for any other mutually equivalent expressions, such as, for example: a) "handling", "processing", "mixing", "blending", "conditioning", "drying", "dehumidifying", "cooling", "treating", "heating" (i.e. opposite of "cooling"), etc.; b) "air", "fluid", "flow", "path", "passage", "stream", etc.; c) "humidity", "moisture", "vapor", "water", etc.; d) "component", "piece", "structure", "accessory", etc.; e) "tab", "protrusion", "rim", "wing", etc.; f) "first", "front", "frontward", "top", "outer", etc.; g) "second", "rear", "rearward", "bottom", "inner", etc.; h) "fastener", "rivet", "pin", etc.; i) "integral", "made of one piece", "made of same piece", etc.; as well as for any other mutually equivalent expression(s), pertaining to the aforementioned expressions and/or to any other structural and/or functional aspects of the present invention, as also apparent to a person skilled in the art. Also, in the context of the present description, expressions such as "can", "may", "might", "will", "could", "should", "would", etc., may also be used interchangeably, whenever appropriate, as also apparent to a person skilled in the art.

Furthermore, in the context of the present description, it will be considered that all elongated objects will have an implicit "longitudinal axis" or "centerline", such as the longitudinal axis of shaft for example, or the centerline of a coiled spring, for example, and that expressions such as "connected" and "connectable", or "mounted" and "mountable", may be interchangeable, in that the present invention also relates to a kit with corresponding components for assembling a resulting fully-assembled and fully-operational air-mixing column, plenum and/or assembly (and/or resulting system provided with such air-mixing column, plenum and/or assembly).

Moreover, components of the present system(s) and/or steps of the method(s) described herein could be modified, simplified, altered, omitted and/or interchanged, without departing from the scope of the present invention, depending on the particular applications which the present invention is intended for, and the desired end results, as briefly exemplified herein and as also apparent to a person skilled in the art.

In addition, although the preferred embodiments of the present invention as illustrated in the accompanying drawings comprise various components, and although the preferred embodiments of the present air-mixing assembly and corresponding portion(s)/part(s)/component(s) as shown consist of certain geometrical configurations, as explained and illustrated herein, not all of these components and geometries are essential to the invention and thus should not be taken in their restrictive sense, i.e. should not be taken so as to limit the scope of the present invention. It is to be understood, as also apparent to a person skilled in the art, that other suitable components and cooperation thereinbetween, as well as other suitable geometrical configurations may be used for the present air-mixing assembly and corresponding portion(s)/part(s)/component(s) according to the present invention, as will be briefly explained herein and as can be easily inferred herefrom by a person skilled in the art, without departing from the scope of the present invention.

Broadly described, and as better exemplified in the accompanying drawings, the present relates to an air-mixing plenum capable of "processing" (ex. "mixing", "conditioning", "drying", "dehumidifying", "cooling", etc.) air, and to be used in a corresponding ventilation system, for example.

As previously explained, air handling units frequently use outdoor air to condition the air of the building they serve. To reduce energy consumption, air handling unit commonly mix the outdoor air with the return air from the building. However, when the temperature of the outdoor air is below the freezing point, the introduction of outdoor air into the air handling unit can cause problems. For instance, equipment such as water coils downstream of the mixed-air streams present a risk of freezing, which results in costly repairs to the system and the building. In addition, a more homogeneous flow allows a better operation of the ventilation unit. It is necessary to perfectly control the two airflows that take place in the mixing section of the air handling unit. The present air-mixing plenum consists of this new equipment, which creates the air-mixing section.

As also previously explained, there are currently several solutions to resolve this problem. The simplest and common design consists of not adding any mixing equipment to protect the equipment against freezing. This solution is acceptable when the temperature variation between the two flows of air is limited (for instance, when the temperature of the outdoor is not below the freezing point or very close to the freezing point). Similarly, it is also possible to add glycol to the water system to protect from freezing. The quantity of glycol can be adjusted depending on the lowest expected temperature. On the other hand, the addition of glycol in a water circuit greatly reduces the thermal performance of the heat transfer coil.

As also previously explained, another alternative is to add a supplemental air-mixing device downstream of the air-mixing plenum. The purpose of the latter is to break the stratification of the air by agitating it in multiple directions. Thus, the two flows mix reducing the extreme temperatures. However, this solution requires a latent zone after the mixing section to allow the air agitation to work. This means that there is more space to consider for this type of solution resulting in additional costs. Also, the dimensional constraints of the units do not always allow to increase the length of the latter. The supplemental air-mixing devices can have good performance but are generally difficult to manufacture and costly.

Finally, and as also previously explained, another alternative consists in an active control of the flows in order to mix the air streams. Concretely, this solution is installed in the mixing box and has several channels. Each air channel has an air flap to control the air passing through it. Although this allows good performance and reduced section length, it increases the complexity of the system. The costs are increased as well as the necessary maintenance.

Referring now to FIG. 1, there is shown an air handling unit 5, in accordance with an embodiment. In this embodiment, the air handling unit 5 includes a first supply fan section 10, return air dampers 20 configured to regulate a return flow of air 22, outdoor air dampers 30 configured to regulate an outdoor flow of air 32, an air-mixing plenum 40, a filter section 50, a humidification section 60, a heating section 70, and a second supply fan section 80. It will be understood that in other embodiments, the air handling unit 5 can omit one or more of the sections specified above and may include additional sections such as, for instance, a UV light section and/or a cooling section.

As indicated above, the air handling unit 5 is configured to regulate and circulate air as part of a heating, ventilating, and air-conditioning system. Notably, the air handling unit 5 can be configured to evacuate at least a portion of the return flow of air 22 provided from within a building, and to introduce within the building at least a portion of the outdoor flow of air 32 provided from an open-air source exterior to the air handling unit 5. In certain embodiments, a desirable exchange of air can be achieved by selectively operating the return air dampers 20 and the outdoor air dampers 30 to regulate a volumetric flow rate of the respective return and outdoor flows of air 22, 32. In particular, each of the return air dampers 20 and the outdoor air dampers 30 includes one or more dampers (not shown) which can be selectively operated to regulate a flow of air across the respective return and outdoor air dampers 20, 30.

Still referring to FIG. 1, the return and outdoor flows of air 22, 32 can be channeled towards the air-mixing plenum 40. In certain embodiments, the air-mixing plenum 40 can be configured to merge the return and outdoor flows of air 22, 32 while achieving a desirable mixing thereof (i.e. a merging of the return and outdoor flows of air 22, 32 which breaks a stratification thereof) at a location downstream of the air-mixing plenum 40.

Figure 2:
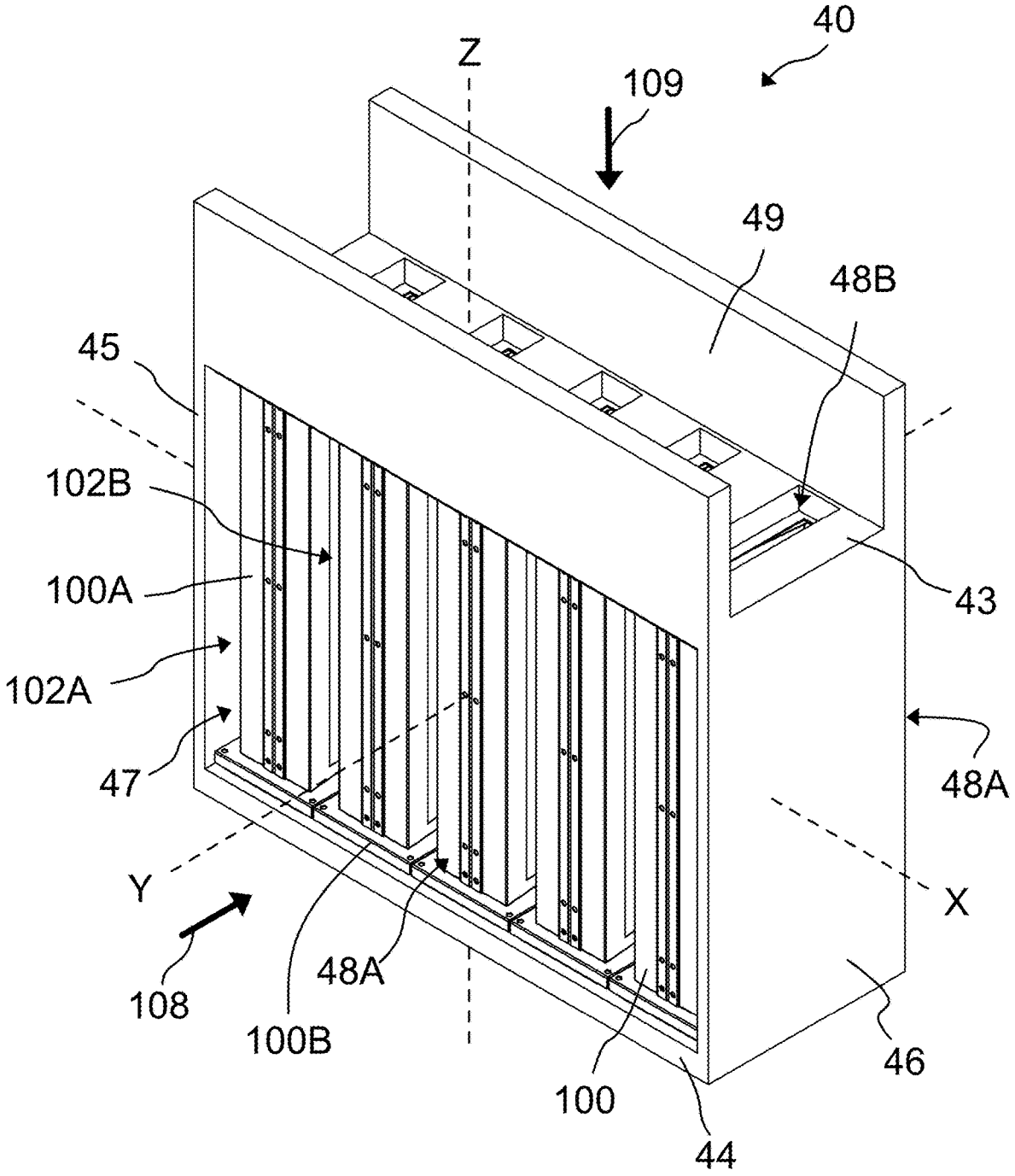
FIG. 2 is a top perspective view of an air-mixing plenum in accordance with an embodiment.

Referring now to FIG. 2, there is shown an air-mixing plenum 40, in accordance with an embodiment. In this embodiment, the air-mixing plenum 40 includes a frame 42 configured to house a plurality of air-mixing columns 100 and to expose said air-mixing columns 100 to the return and outdoor flows of air 22, 32. In the illustrated embodiment, the frame 42 includes top and bottom panels 43, 44 which are spaced vertically from each other, and which extend substantially parallel to each other, and first and second side walls 45, 46 which are spaced from each other and extend between the top and bottom panels 43, 44. Notably, top panel 43, the bottom panel 44, and the first and second sidewalls 45, 46 define a column receiving volume 47 configured to receive one or more of the air-mixing columns 100 therein.

In certain embodiments, the frame 42 defines transverse openings 48A extending in a vertical direction Z of the frame 42 between the top and bottom panels 43, 44, and extending in a longitudinal direction X of the frame 42 between first and second side walls 45, 46. The transverse openings 48A can be configured to expose one or more of the air-mixing columns 100 to a first flow of air 108 travelling in a transverse direction Y of the air-mixing plenum 40. More specifically, the frame 42 defines transverse openings 48A on both sides of the air-mixing columns 100 in the transverse direction Y of the air-mixing plenum 40 to allow a flow of air in and out of the air-mixing plenum 40.

In certain embodiments, the top panel 43 of the frame 42 further defines a plurality of top openings 48B configured to receive a second flow of air 109 travelling in the vertical direction Z of the air-mixing plenum 40 and to channel said second flow of air 109 to one or more of the air-mixing columns 100 disposed within the frame 42. In the illustrated embodiment, the top panel 43 defines a distinct top opening 48B for each of the air-mixing columns 100 with each of the top openings 48B being aligned with a channel opening 118 of a corresponding air-mixing column 100 as will be explained further below. It will be understood that, in other embodiments, the top panel 43 of the frame 42 can define top openings 48B spanning two or more of the air-mixing columns 100.

Referring again to the embodiment shown FIG. 1, the air-mixing plenum 40 is disposed within the air handling unit 5 in a vertical configuration to receive the return flow of air 22 in the transverse direction Y of the air-mixing plenum 40, and the outdoor flow of air 32 in the vertical direction Z of the air-mixing plenum 40. Accordingly, the first flow of air 108 passing through the transverse openings 48A corresponds to the return flow of air 22, and the second flow of air 109 passing through the top openings 48B corresponds to the outdoor flow of air 32. It is to be understood that, in other embodiments, the air-mixing plenum 40 can be disposed within the air handling unit 5 in any other suitable configuration to receive a select one of the return and the outdoor flows of air 22, 32 in the desired one of the transverse openings 48A and the top openings 48B.

In certain embodiments, the air-mixing plenum further includes one or more baffles 49 extending from the frame 42 to restrict or prevent a flow of at least one of the return and outdoor flows of air 22, 32 across a portion of the air-mixing plenum 40. For instance, in the illustrated embodiment, the baffles 49 of the frame 42 restrict or prevent a flow of air in a region above the air-mixing plenum 40.

Figure 3:
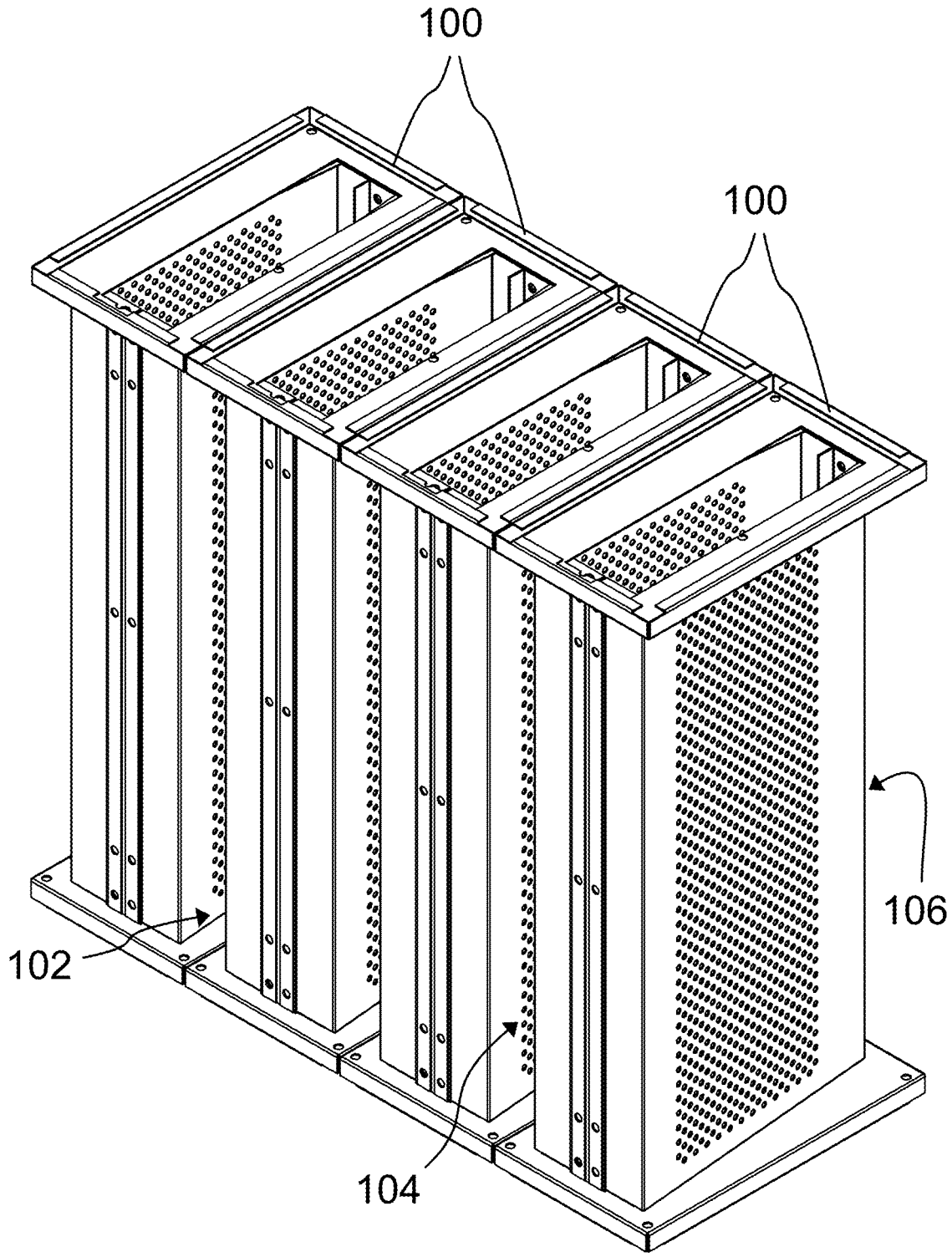
FIG. 3 is a top perspective view of a plurality of air-mixing columns of the air-mixing plenum shown in FIG. 2, the plurality of air-mixing columns being positioned in an adjacent configuration, in accordance with an embodiment.
Figure 4:
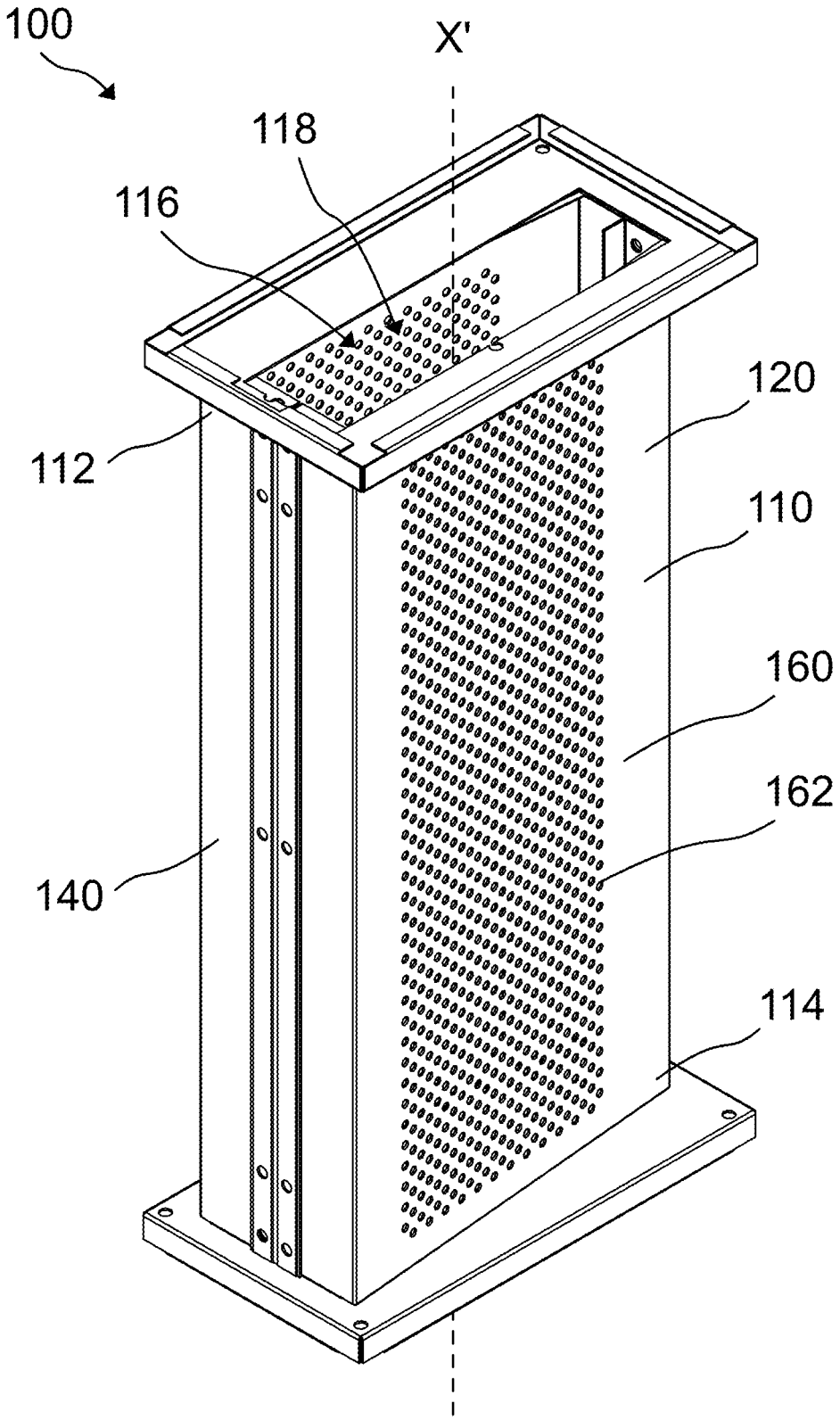
FIG. 4 is a top perspective view of an air-mixing column of the air-mixing plenum shown in FIG. 2, in accordance with an embodiment.
Figure 5:
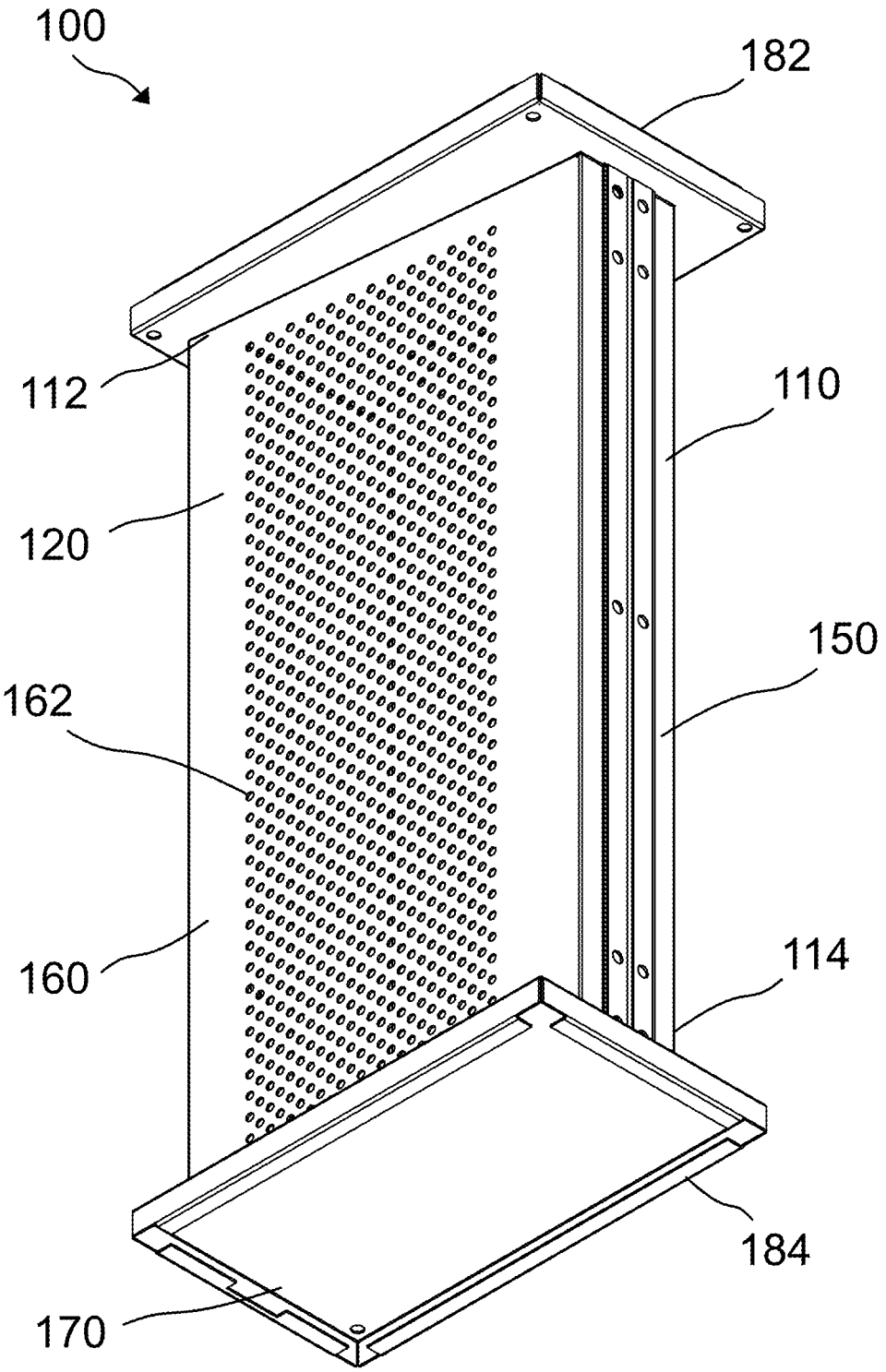
FIG. 5 is a bottom perspective view of the air-mixing column shown in FIG. 4.
Figure 6:
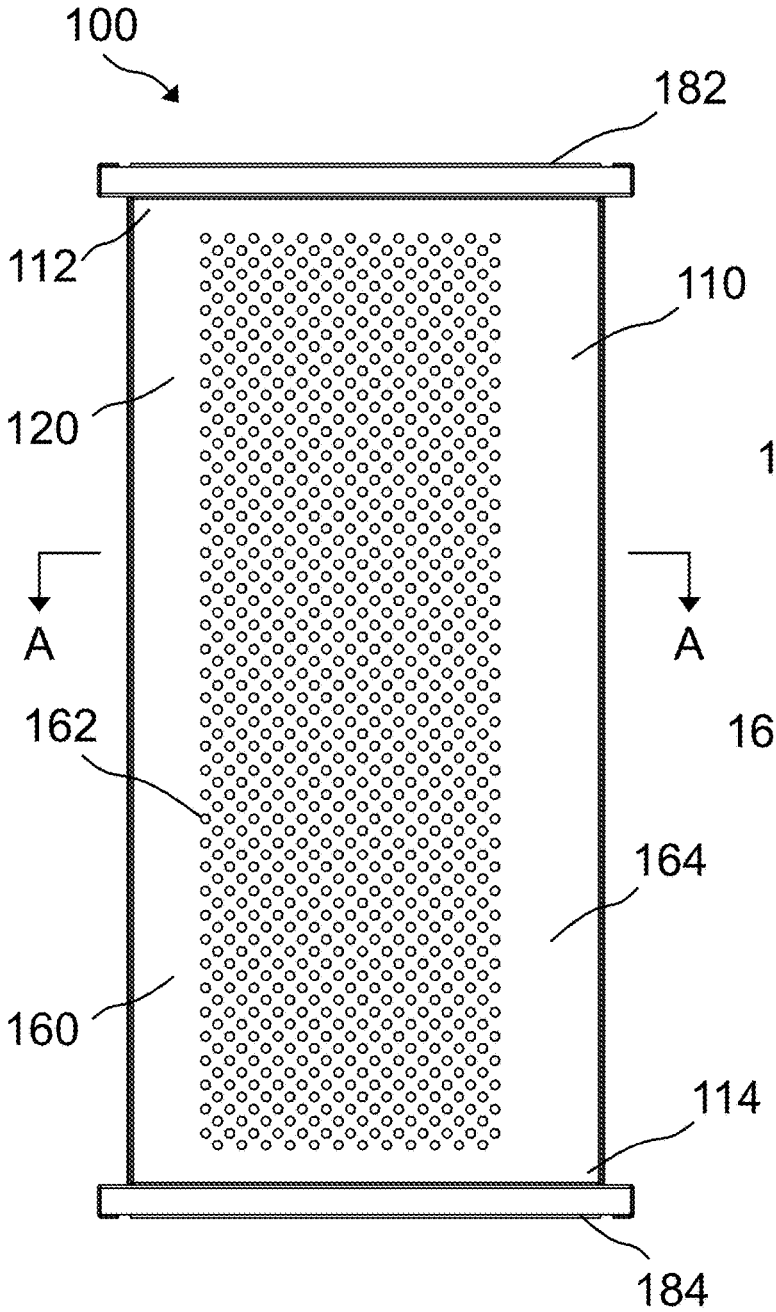
FIG. 6 is a right elevation view of the air-mixing column shown in FIG. 4.
Figure 7:
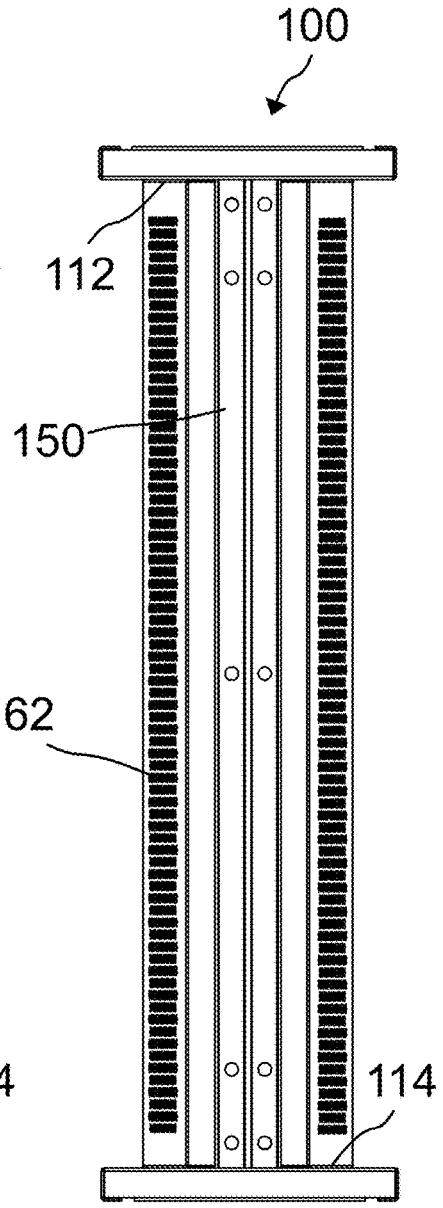
FIG. 7 is a front elevation view of the air-mixing column shown in FIG. 4.
Figure 8:
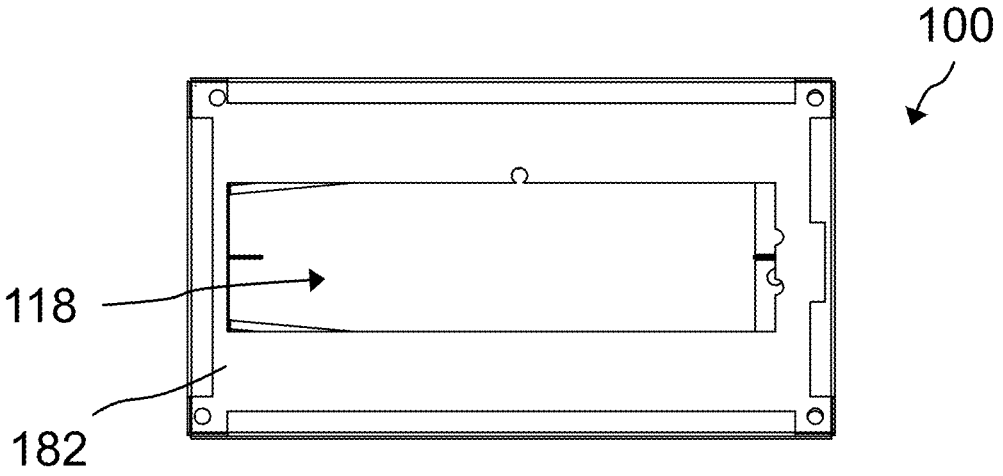
FIG. 8 is a top plan view of the air-mixing column shown in FIG. 4.
Figure 9:
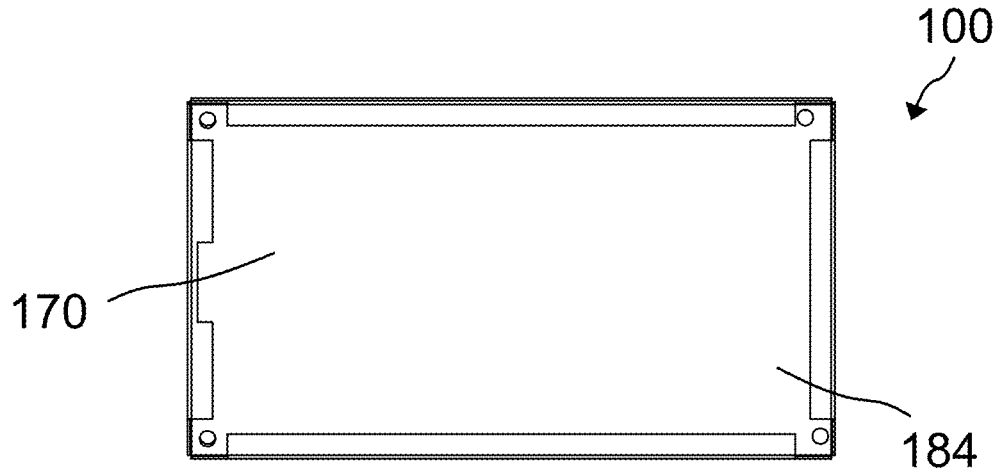
FIG. 9 is a bottom plan view of the air-mixing column shown in FIG. 4

Referring now to FIG. 3, there is shown a plurality of air-mixing columns 100 of the air-mixing plenum 40, in accordance with an embodiment. The air-mixing columns 100 are disposed relative to one another in a configuration suitable for installation within the frame 42 of the air-mixing plenum 40. In the illustrated embodiment, the air-mixing plenum 40 includes four air-mixing columns 100 that are placed adjacent and substantially parallel to each other so as to expose each of the air-mixing columns 100 to the first flow of air 108 through the transverse openings 48A of the frame 42. More specifically, the air-mixing columns 100 are placed in a linear configuration along a longitudinal axis X of the air-mixing plenum 40 (as shown in FIG. 2). In the illustrated embodiment, at least a portion of each of the air-mixing columns 100 abuts a portion of an adjacent one of the air-mixing columns 100 although, in other embodiments, the air-mixing columns 100 can be placed adjacent to each other at a distance to define a gap therebetween. It will be understood that the term "column" as used herein refers to any elongated member and is not intended to define a particular position of the elongated member (ex. an upright position) or a particular shape of the elongated member (ex. a "cylindrical" shape).

Referring now to the embodiment shown in FIGS. 2 and 3, each of the air-mixing columns 100 defines a flow conduit 102 extending between an outer surface of the respective air-mixing column 100 and a neighbouring surface of the air-mixing column 100 for receiving the first flow of air 108. For instance, in this embodiment, a first air-mixing column 100A of the air-mixing columns 100 defines a first flow conduit 102A between itself and the neighbouring first side wall 45 of the frame 42. The first air-mixing column 100A further defines a second flow conduit 102B between itself and a neighbouring surface of the adjacent air-mixing column 100B. Each of the air-mixing columns 100 further defines a plenum inlet 104 and a plenum outlet 106 adapted to receive the first flow of air 108 within the corresponding flow conduit 102, and to exhaust air out of the corresponding flow conduit 102, respectively.

Referring now to FIGS. 4 to 10, there is shown an air-mixing column 100 of the air-mixing plenum, in accordance with an embodiment. In the illustrated embodiment, the air-mixing column 100 includes a hollow elongated body 110 extending from a first end 112 to a second end 114 along a longitudinal axis X' of the elongated body 110. The elongated body 110 defines a channel 116 extending along said longitudinal axis X' of the elongated body 110, and a channel opening 118 at the first end 112 of the elongated body 110 for receiving a flow of air into the channel 116. As indicated above, the air-mixing column 100 can be disposed within the frame 42 to align the channel opening 118 with at least one of the one or more top openings 48B of the frame 42 to receive the second flow air within the channel 116.

Figure 10:
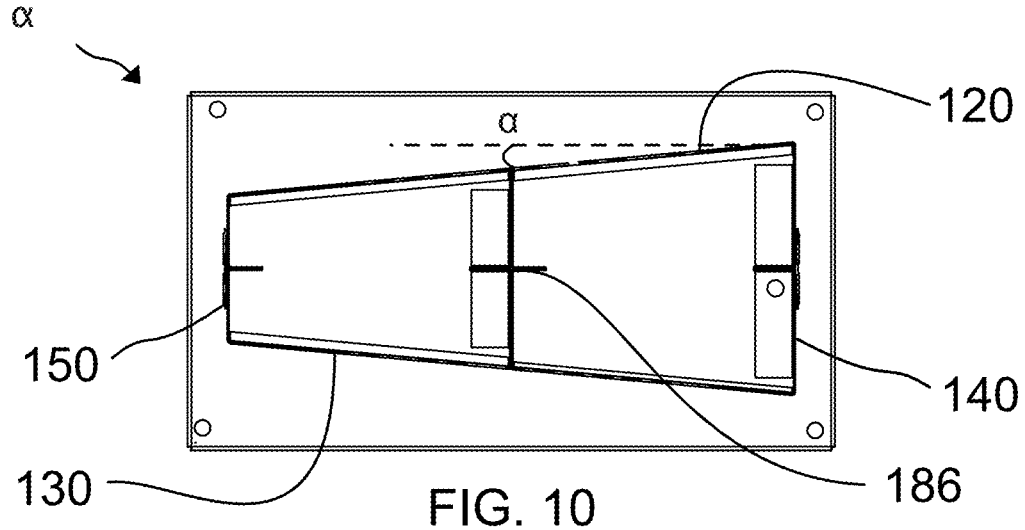
FIG. 10 is a cross-sectional view, taken along cross-sectional plane A-A, of the air-mixing column shown in FIG. 6.

In the illustrated embodiment, the elongated body 110 has a generally polyhedral shape having a polygonal transverse cross-sectional shape (e.g. a quadrilateral or triangular transverse cross-sectional shape) defining first and second lateral walls 120, 130, as well as first and second end walls 140, 150. Referring to FIG. 10, a cross-sectional view along a transverse plane of the air-mixing column 100 is illustrated showing a substantially trapezoidal cross-sectional shape of the elongated body 110. In particular, a width of the first end wall 140 is greater than a width of the second end wall 150. In certain embodiments, wherein each of the air-mixing columns 100 of the air-mixing plenum 40 includes a like configuration, the adjacent ones of the air-mixing columns 100 can define a plenum outlet 106 of the flow conduit 102 having a surface area that is greater than a surface area of the plenum inlet 104 of the corresponding flow conduit 102. More specifically, in some embodiments, a ratio of the surface area of the plenum outlet 106 to the surface area of the plenum inlet 104 can be greater than 2. In other embodiments, a ratio of the surface area of the plenum outlet 106 to the surface area of the plenum inlet 104 can be greater than 3.

As indicated above, the air-mixing columns 100 can be configured to enable an exchange of air between the first and second flows of air 108, 109. More specifically, the air-mixing columns 100 can be configured to enable an exchange of air between the first flow of air 108 flowing through the one or more flow conduits 102 and the second flow of air 109 flowing through the channel 116. To that end, in some embodiments, at least one of the first and second lateral walls 120, 130 can include a perforated surface 160 defining a plurality of air flow perforations 162 enabling an exchange of air between the first and second flows of air 108, 109. More specifically, one of the first and second flows of air 108, 109 can flow across the perforated surface 160 in accordance with a fluid pressure differential generated across the perforated surface 160. For instance, in certain embodiments, a dynamic fluid pressure of the second flow of air 109 within the channel 116 of the air-mixing column 100 can exceed the dynamic fluid pressure of the first flow of air 108 within the flow conduit 102 to convey the second flow of air 109 across the perforated surface thereby mixing the first and second flows of air 108, 109 within the flow conduit 102.

In the illustrated embodiment, the air flow perforations 162 of the perforated surface 160 defines a substantially circular opening. In other embodiments, the air flow perforations 162 can include any other suitable shaping including, for instance, a square, an oblong, a rectangle, a triangle, or any other polygonal or non-polygonal shape.

In certain embodiments, the perforated surface 160 can be defined over a portion of the corresponding first and second lateral walls 120, 130. For instance, in certain embodiments, the perforated surface 160 can be defined over at least 70% of the corresponding first and second lateral walls 120, 130. In other embodiments, the perforated surface 160 can be defined over at least 80% of the corresponding first and second lateral walls 120, 130. In other embodiments still, the perforated surface 160 can be defined over at least 90% of the corresponding first and second lateral walls 120, 130. In the illustrated embodiment, each of the first and second lateral walls 120, 130 includes a downstream portion 164 devoid of perforations defined at a distal region of the perforated surface 160 along the flow direction the first flow of air 108. In other embodiments, each of the first and second lateral walls 120, 130 can include a portion devoid of perforations defined within any other region of the first and second lateral walls 120, 130.

In certain embodiments, a base 170 of the air-mixing column 100 defined at the second end 114 of the air-mixing column 100 can be devoid of openings to restrict a flow of air therethrough. Accordingly, in such embodiments, the dynamic fluid pressure within the channel 116 of the air-mixing column 100 can increase relative to a dynamic fluid pressure of the first flow of air 108 thereby promoting a further exchange of air across the perforated surface 160. In certain embodiments, the second end 114 of the air-mixing column 100 can be devoid of openings to obstruct the flow of air therethrough thereby conveying an entirety of the second flow of air 109 across the perforated surface 160 to merge with the first flow of air 108 within the one or more flow conduits 102.

As the exchange of air is initiated at an upstream portion of the second flow of air 109 as it flows across a region of the perforated surface 160 of at least one of the first and second lateral walls 120, 130 proximate the first end 112 of the elongated body 110, a dynamic pressure of the second flow of air 109 can decrease in a flow direction of the second flow of air 109 within the channel 116 thereby reducing an efficiency of the exchange of air across a region of the perforated surface proximate the second end 114 of the elongated body 110. To promote a more effective exchange of air near the second end 114 of the elongated body 110, in certain embodiments, the perforated surface 160 can define a subset of air flow perforations 162 located near the second end 114 of the elongated body having a surface area being greater than the surface area of the air flow perforations 162 defined upstream thereof.

Referring again to FIG. 10, the substantially trapezoidal cross-sectional shape of the elongated body 110 can define first and second lateral walls 120, 130 extending at an angle relative to a flow direction of the first flow of air 108. More specifically, at least one of the first and second lateral walls 120, 130 can be angled outwardly with respect to the flow direction of the first flow of air 108. In certain embodiments, at least one of the first and second lateral walls 120, 130 can define an acute angle $\alpha$ with the flow direction of the first flow of air 108. For instance, in certain embodiments, the acute angle $\alpha$ can be greater than 5 degrees relative to the flow direction of first flow of air 108. In other embodiments, the acute angle $\alpha$ can be greater than 7.5 degrees relative to the flow direction of first flow of air 108. In other embodiments still, the acute angle $\alpha$ can be greater than 10 degrees relative to the flow direction of first flow of air 108. It is to be understood that, in other embodiments, at least one of the first and second lateral walls 120, 130 can define any other suitable angle with the flow direction of the first flow of air 108.

In certain embodiments, the fact of defining angled first and second lateral walls relative to the first flow of air 108 to be mixed enables to expose said flow of air to an increased operative processing area, for an increased processing capability of the first flow of air 108, while also enabling a reduced speed of the air to be processed, which advantageously minimizes pressure loss within the ventilation system. Indeed, by increasing the operative processing area through which the air to be processed has to flow through, this in turn decreases its flow speed, and thus, in turn, reduces a possible pressure loss, which can be desirable, as can be easily understood by a person skilled in the art.

It is to be understood that, while the present embodiments of the air-mixing column 100 have been illustrated and described with reference to an air-mixing column 100 having a substantially trapezoidal transverse cross-sectional profile, in other embodiments, the air-mixing column 100 can include any other suitable transverse cross-sectional profile defining an increased flow path along at least one of the first and second lateral walls 120, 130 for increasing the operative processing area of the perforated surface 160.

To evaluate the performance of the present air-mixing plenum 40, the flow characteristics of the merged first and second flows of air 108, 109 can be evaluated at a plane of reference downstream of the air-mixing plenum 40 equivalent to the smallest of the two dimensions of a unit section of the air-mixing plenum 40. For example, for an air-mixing plenum 40 with a unit section of 100 in×80 in, the performance of the air-mixing plenum 40 can be evaluated at 80 in downstream of the air-mixing plenum 40. The performance of the air-mixing plenum can be evaluated in accordance with two criteria allowing to validate the homogenization and the reduction of freezing. The first criteria, named "Air Mixing Ratio" (AMR) allows to compare the extremes of the mixed first and second flows of air 108, 109 to the extremes prior to their merging (with a higher percentage indicating a more homogenous mixture of the first and second flows of air 108, 109). The second criteria is the coefficient of temperature variation. Indeed, it is desirable to be as low as possible for a better homogeneity thereby limiting a stratification of the merged flows of air. In accordance with certain embodiments, the air-mixing plenum 40 defined above can achieve AMR of over 70% and, in accordance with other embodiments over 80%. In accordance with certain embodiments, the air-mixing plenum 40 defined above can further achieve a coefficient of a variation of about 20%. At this performance, it can also be necessary to evaluate the energy requirement (i.e. pressure drops generated by the air-mixing plenum 40 compared to an empty mixing box). In certain embodiments, the air-mixing plenum 40 can incur a pressure drop between 0.15 in. w.g. and 0.5 in. w.g. In addition to the benefit of providing improved air mixing, the present innovative equipment is relatively simple to manufacture, has no moving parts, and does not require the addition of a downstream mixing zone.

Figure 12:
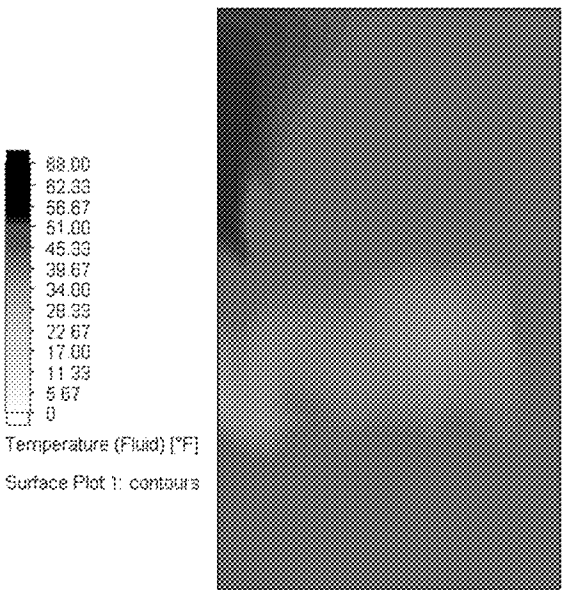
FIG. 12 is a graphical representation of a temperature distribution at a measuring plane downstream of an air mixing plenum, in accordance with an embodiment of the air-mixing plenum shown in FIG. 1.
Figure 11:
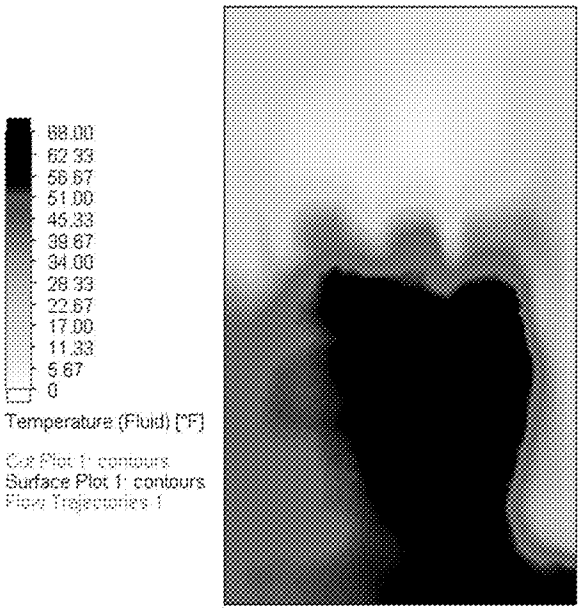
FIG. 11 (PRIOR ART)
FIG. 11 is a graphical representation of a temperature distribution at a measuring plane downstream of an air mixing plenum, in accordance with the prior art.

Referring to FIGS. 11 and 12, comparative graphical representations are shown of a temperature distribution at a measuring plane downstream of a prior art air-mixing plenum, and the air-mixing plenum 40 described above, respectively. As shown, the air-mixing plenum 40 described above can achieve a greater temperature homogeneity with reduced stratification of the first and second flows of air 108, 109 at a reference plane downstream of the air-mixing plenum 40. As indicated above, the improved merging of the first and second flows of air 108, 109 and uniformization of the temperatures across the reference plane can improve the general efficiency of the air handling unit 5, prevent damage to components of the air handling unit 5 disposed downstream of the air-mixing plenum 40, and prevent undesirable condensation on various surfaces of the air handling unit 5 thereby reducing the pooling of water therein.

In light of the above, the air handling unit 5 including the air-mixing plenum 40 can, in accordance with certain embodiments, provide a desirable quality of air within a building by introducing a reduced volume of air from the outdoor flow of air 32. For instance, in certain embodiments, the air handling unit 5 can provide a desirable air quality with a mixture of the first and second flows of air 108, 109 comprising less than 30% of air provided from the outdoor flow of air 32. In other embodiments, the air handling unit 5 can provide a desirable air quality with a mixture of the first and second flows of air 108, 109 comprising less than 20% of air provided from the outdoor flow of air 32.

Referring again to FIGS. 4 to 10, in certain embodiments, the air-mixing column 100 further includes upper and lower brim portions 182, 184 extending from the first and second ends 112, 114 of the elongated body 110, respectively. The upper and lower brim portions 182, 184 of the air-mixing column 100 can improve a structural integrity of the air-mixing column. In certain embodiments, the upper brim portion 182 can further promote a channeling of the second flow of air 109 towards the conduit 116 of the air-mixing column 100. In certain embodiments, the air-mixing column 100 can further include an internal brace 186 (shown in FIG. 10) extending within the conduit 116 of the elongated body 110 to further provide structural support to the air-mixing column 100.

As indicated above, the air mixing plenum 40 can be installed in an air handling unit 5 configured to receive an outdoor flow of air 32 having a reduced temperature. In such instances, a temperature of the air-mixing plenum 40 configured to receive the outdoor flow of air 32 can drop below a dew point of the first flow of air 108 thereby promoting the formation of dew onto a surface of the air-mixing plenum 40. To limit the formation of dew onto the surface of the air-mixing plenum 40 and the accumulation of water within or in a region around the air-mixing plenum 40, in certain embodiments, at least a portion of the air-mixing plenum 40 can be coated in a thermal insulating coating to maintain a temperature of the elongated body above the dew point of the first and second flows of air 108, 109. More specifically, in some embodiments, a portion of the air-mixing columns 100 can be coated in a thermal insulating coating. In some implementations, the thermal insulating coating can include high-density polyethylene or any other material including a low thermal conductivity.

In certain embodiments, the air-mixing plenum 40 can be configured to enable at least a portion of the first air flow to bypass the air-mixing columns 100 and thus limit an exchange of air with the second air flow. In particular, the air-mixing plenum 40 can define a bypass conduit (not shown) comprising a bypass inlet disposed in the first flow of air 108. The bypass channel can further extend around the mixing column and be configured to selectively receive the first flow of air 108 and to channel said flow of air to a location downstream of the air-mixing plenum 40 to avoid a mixing of at least a portion of the first flow of air 108 with the second flow of air 109.

The present invention can be further directed to a method of mixing the first and second flows of air 108, 109 having different temperatures. In particular, the method can include exposing at least one of the air-mixing columns 100 of the air-mixing plenum 40 to the first flow of air 108, channeling the second flow of air 109 through the channel 116 of the air-mixing column 100, channeling the first flow of air 108 along the perforated surface 160 of the air-mixing column 100, and forming a pressure differential across the perforated surface 160 to generate a mixture of the first and second flows of air 108, 109.

In some embodiments, the method can further include exhausting the mixture of the first and second flows of air 108, 109 out of the air-mixing plenum 40 in the first flow direction 108.

In some embodiments, the method can further include operating the outdoor air damper 30 to selectively regulate a volumetric flow rate of the second flow of air 109 and to optionally form a mixture ratio of the first and second flows of air 108, 109 comprising less than 20% of the second flow of air 109.

In some embodiments, the method can further include thermally insulating the air-mixing plenum 40 to maintain a temperature a surface of the air-mixing plenum above a dew point of the first and second flows of air 108, 109.

As can now be better appreciated, and as can be easily understood and/or easily inferred from the present patent application and accompanying drawings, the present air-mixing plenum 40 may come in the form of an air-mixing plenum 40 including one and/or several of the following possible components and features (and/or different possible combination(s) and/or permutation(s) thereof):

i.) A mixing plenum comprising at least one mixing column configured to be disposed in a first flow of air, the mixing column comprising:

an elongated body defining a channel extending along a longitudinal axis of said elongated body, the elongated body comprising at least one perforated surface, the at least one perforated surface forming an angle with a flow direction of the first flow of air;

wherein the channel is adapted to receive a second flow of air, the mixing column being configured to generate a mixture of the first and second flows of air across the at least one perforated surface.

ii.) The mixing plenum of any one of the preceding combination(s), wherein the elongated body of the at least one mixing column and a first neighbouring surface of the elongated body define a plenum inlet therebetween adapted to receive the first flow of air.

iii.) The mixing plenum of any one of the preceding combination(s), wherein the elongated body of the at least one mixing column and a second neighbouring surface of the elongated body define a plenum outlet therebetween adapted to exhaust one of a portion of the first flow of air, and the mixture of the first and second flows of air.

iv.) The mixing plenum of any one of the preceding combination(s), wherein a surface area of the plenum outlet is greater than a surface area of the plenum inlet.

v.) The mixing plenum of any one of the preceding combination(s), wherein the mixing column comprises a brim portion extending from a first end of the elongated body.

vi.) The mixing plenum of any one of the preceding combination(s), wherein the at least one perforated surface and the brim portion define at least a portion of a second channel extending from the plenum inlet to the plenum outlet, the second channel being adapted to receive the first flow of air.

vii.) The mixing plenum of any one of the preceding combination(s), wherein the at least one perforated surface is angled outwardly with respect to the flow direction of the first flow of air to define an acute angle with respect to the flow direction of the first flow of air.

viii.) The mixing plenum of any one of the preceding combination(s), wherein the perforated surface comprises a downstream portion defined at a distal end of the perforated surface along the first flow of air, the downstream portion of the perforated surface being devoid of perforations.

ix.) The mixing plenum of any one of the preceding combination(s), wherein at least a portion of the mixing plenum is coated in a thermal insulating coating to maintain a temperature of the elongated body above a dew point of the first and second flows of air.

x.) The mixing plenum of any one of the preceding combination(s), wherein the thermal insulating coating comprises high-density polyethylene.

xi.) The mixing plenum of any one of the preceding combination(s), wherein the perforated surface defines a plurality of air flow perforations, and wherein a surface area of the respective air flow perforations increases along a flow direction of the second flow of air.

xii.) The mixing plenum of any one of the preceding combination(s), wherein the mixing plenum defines a bypass conduit comprising a bypass inlet disposed in the first flow of air, the bypass channel extending around the mixing column and being configured to selectively receive the first flow of air.

xiii.) The mixing plenum of any one of the preceding combination(s), the mixing plenum further comprising a frame adapted to receive a plurality of mixing columns, the plurality mixing columns being aligned in an adjacent configuration in a direction being normal to the flow direction of the first flow of air.

xiv.) The mixing plenum of any one of the preceding combination(s), wherein the elongated body comprises a closed end configured to restrict a flow of the second flow of air, the channel of the elongated body being configured to direct an entirety of the second flow of air to the perforated surface.

xv.) The mixing plenum of any one of the preceding combination(s), wherein the elongated body comprises a trapezoidal transverse cross-sectional shape.

xvi.) A method of mixing first and second flows of air having different temperatures, the method comprising:

exposing an air-mixing column of an air-mixing plenum to the first flow of air, the first flow of air defining a first flow direction;

channeling the second flow of air through a channel extending through the air-mixing column along a longitudinal axis thereof;

channeling the first flow of air along a perforated surface of the air-mixing column, the perforated surface forming an angle with the first flow direction; and forming a pressure differential across the perforated surface to generate a mixture of the first and second flows of air.

xvii.) The method of any one of the preceding combination(s), further comprising exhausting the mixture of the first and second flows of air out of the air-mixing plenum in the first flow direction.

xviii.) The method of any one of the preceding combination(s), further comprising operating a damper to selectively regulate a volumetric flow rate of the second flow of air.

xix.) The method of any one of the preceding combination(s), further comprising operating the damper to form a mixture ratio of the first and second flows of air comprising less than 20% of the second flow of air.

xx.) The method of any one of the preceding combination(s), further comprising thermally insulating at least a portion of the air-mixing plenum to maintain a temperature of the surface of the air-mixing plenum above a dew point of the first and second flows of air.

In accordance with another aspect, the present air-mixing plenum 40 may also come in the form of an air-mixing plenum 40 including one and/or several of the following possible components and features (and/or different possible combination(s) and/or permutation(s) thereof):

i.) An air-mixing plenum comprising at least one air-mixing column configured to be disposed in a first flow of air, the air-mixing column comprising:

an elongated body defining a channel along a longitudinal axis of said elongated body, the elongated body comprising at least one perforated surface, the at least one perforated surface forming an angle with a flow direction of the first flow of air;

wherein the channel is adapted to receive a second flow of air, the second flow of air mixing with the first flow of air across the at least one perforated surface.

ii.) The air-mixing plenum of any one of the preceding combination(s), wherein the elongated body and a first neighbouring surface of the air-mixing plenum define an air inlet therebetween adapted to receive the first flow of air.

iii.) The air-mixing plenum of any one of the preceding combination(s), wherein the elongated body and a second neighbouring surface of the air-mixing plenum further define an air outlet therebetween adapted to exhaust at least one of a portion of the first flow of air, and a mixture of the first flow of air and the second flow of air.

iv.) The air-mixing plenum of any one of the preceding combination(s), wherein a surface area of the air outlet is greater than a surface area of the air inlet.

v.) The air-mixing plenum of any one of the preceding combination(s), wherein a ratio of the surface area of the air outlet to the surface area of the air inlet is greater than 2.

vi.) The air-mixing plenum of any one of the preceding combination(s), wherein a ratio of the surface area of the air outlet to the surface area of the air inlet is greater than 3.

vii.) The air-mixing plenum of any one of the preceding combination(s), the elongated body comprising a brim portion extending from a first end of said elongated body.

viii.) The air-mixing plenum of any one of the preceding combination(s), wherein the at least one perforated surface and the brim portion define at least a portion of a second channel adapted to receive the first flow of air.

ix.) The air-mixing plenum of any one of the preceding combination(s), wherein the second channel extends from the air inlet to the air outlet.

x.) The air-mixing plenum of any one of the preceding combination(s), wherein the at least one perforated surface comprises an open area greater than about a given percentage (ex. between about 20% and about 25%, and preferably/optionally, greater than about 22%).

xi.) The air-mixing plenum of any one of the preceding combination(s), wherein the at least one perforated surface defines an acute angle with the flow direction of the first flow of air.

xii.) The air-mixing plenum of any one of the preceding combination(s), wherein the acute angle is greater than 5 degrees.

xiii.) The air-mixing plenum of any one of the preceding combination(s), wherein the acute angle is greater than 7.5 degrees.

xiv.) The air-mixing plenum of any one of the preceding combination(s), wherein the acute angle is greater than 10 degrees.

xv.) The air-mixing plenum of any one of the preceding combination(s), wherein the at least one perforated surface is angled outwardly from the flow direction of the first flow of air.

xvi.) The air-mixing plenum of any one of the preceding combination(s), wherein the perforated surface comprises a first end being upstream along the first flow of air, the first end of the perforated surface being devoid of perforations.

xvii.) The air-mixing plenum of any one of the preceding combination(s), wherein the channel of the elongated body comprises a trapezoidal cross-sectional shape.

xviii.) The air-mixing plenum of any one of the preceding combination(s), wherein a temperature of the first flow of air is lower than a temperature of the second flow of air.

xix.) The air-mixing plenum of any one of the preceding combination(s), wherein the elongated body comprises first and second lateral sides, the first lateral side being upstream of the second lateral side along the flow direction of the first flow of air.

xx.) The air-mixing plenum of any one of the preceding combination(s), wherein a width of the first lateral side is greater than a width of the second lateral side.

xxi.) The air-mixing plenum of any one of the preceding combination(s), wherein the first lateral side comprises a flat surface, the flat surface being substantially orthogonal to the flow direction of the first flow of air.

xxii.) The air-mixing plenum of any one of the preceding combination(s), the air-mixing plenum comprising a frame adapted to receive a plurality of air-mixing columns, the air-mixing columns being disposed substantially parallel.

xxiii.) An air-mixing column configured to be installed in the air-mixing plenum of any one of the preceding combination(s).

xxiv.) The air-mixing column of any one of the preceding combination(s), wherein the air-mixing column is manufactured by at least one of a metal stamping process and a laser cutting process.

xxv.) A kit for assembling an-air mixing plenum, the kit comprising:

an air mixing plenum frame; and at least one air-mixing column as defined in any one of the preceding combination(s).

xxvi.) One or more die sections adapted to process a metal flat sheet for the metal stamping of at least a portion of the air-mixing column of any one of the preceding combination(s).

xxvii.) The one or more die sections of any one of the preceding combination(s), the one or more die sections being suitable for one or more of a punching process, a blanking process, an embossing process, a coining process, a bending process, and a flanging process.

xxviii.) The one or more die sections of any one of the preceding combination(s), the one or more die sections being adapted to be used in at least one of a mechanical press, a hydraulic press, and a mechanical servo press.

xxix.) A method of mixing first and second flows of air having different temperatures, the method comprising:

exposing an air-mixing column to the first flow of air, the first flow of air defining a first flow direction;

channeling the second flow of air through a channel extending through the air-mixing column along a longitudinal axis thereof;

channeling the first flow of air along a perforated surface of the air-mixing column, the perforated surface forming an angle with the first flow direction; and forming a pressure differential across the perforated surface.

As can now be better appreciated, the present air-mixing approach (ex. column, plenum, assembly, etc.) is very advantageous in that, contrary to other conventional devices that are complicated, long and very costly to manufacture, install and/or maintain, the present system allows the air-mixing components (ex. column, plenum, etc.) to be easily, quickly, conveniently and inexpensively assembled and installed, while ensuring an improved processing capability of the air flow(s) of the ventilation system to be mixed, etc.

Indeed, according to one possible embodiment of the present system, sheet material (ex. sheet metal, etc.) can be easily, quickly, conveniently and inexpensively cut-out and bent, and closed-off with side tabs and/or corresponding fasteners (ex. rivets, etc.), so as to create a corresponding resulting air-mixing components and/or fully-operational assembly.

Furthermore, the fact of providing "slanted" (ex. angled, etc.) surfaces against air flow(s) of a ventilation system to be processed (ex. mixed, etc.) can expose said air flow(s) to an increased operative processing area, for an increased processing capability of the air flow(s) of the ventilation system to be processed, while enabling also a "reduced speed" of the air to be processed, which advantageously "minimizes pressure loss" within the ventilation system. Indeed, by increasing the operative processing area through which the air to be processed has to "pass through" (ex. due to the provision of "slanted" (ex. angled, etc.) surfaces, etc.), this in turn decreases its flow speed, and thus, in turn, reduces a possible pressure loss, which is also very desirable, as can be easily understood by a person skilled in the art.

Additionally, the present air-mixing approach (ex. column, plenum, assembly, etc.) is also advantageous in that the panel(s), contrary to other conventional alternatives, may be easily inspected, cleaned, maintained, repaired and/or replaced. Indeed, according to one possible embodiment of the present system, the air-mixing assembly (and/or associated components, such as air-mixing column, air-mixing plenum, etc.) can be easily, quickly and conveniently insertable into (and thus, conversely, easily removeable from) a corresponding component of the ventilation system.

As can be easily understood, in addition to the various innovative components and features of the present system, and explained and/or exemplified in the present patent specification, the air-mixing assembly according to the present invention could also be provided with various other known components and features of other conventional air-mixing devices, materials and/or the like being well known (ex. display, electronics, safety features, etc.), as apparent to a person skilled in the art.

Furthermore, the present air-mixing assembly is advantageous in that it offers an innovative design with minimal components that can be modular and/or interchangeable depending on the applications(s) for which the air-mixing assembly is intended for, and the desired end result(s), and to be able to do so in a safe, clean, simple, compact, convenient and cost-effective manner.

The present air-mixing assembly and corresponding parts can be made of substantially rigid materials, such as metallic materials, hardened polymers, composite materials, polymeric materials, and/or the like, so as to ensure a proper operation thereof depending on the particular applications for which the air-mixing assembly (and/or corresponding parts thereof, etc.) is intended and the different parameters (loads, temperatures, etc.) in cause, as apparent to a person skilled in the art.

Of course, and as can be easily understood by a person skilled in the art, the scope of the claims should not be limited by the possible embodiments set forth in the examples, but should be given the broadest interpretation consistent with the description as a whole.

Furthermore, although preferred embodiments of the present invention have been briefly described herein and illustrated in the accompanying drawings, it is to be understood that the invention is not limited to these embodiments and that various changes and modifications could be made without departing form the scope and spirit of the present invention, as defined in the appended claim(s) and/or as apparent to a person skilled in the art.

The invention claimed is:

1. A mixing plenum comprising at least one mixing column configured to be disposed in a first flow of air, the at least one mixing column comprising:

an elongated body defining a channel extending along a longitudinal axis of said elongated body, the elongated body comprising a first lateral wall, a second lateral wall, a first end wall and a second end wall, and at least one perforated surface located within the first lateral wall or the second lateral wall, such that the at least one perforated surface forms an angle with a flow direction of the first flow of air;

wherein the channel is adapted to receive a second flow of air, the at least one mixing column being configured to generate a mixture of the first and second flows of air across the at least one perforated surface.

2. The mixing plenum of claim 1, wherein the elongated body of the at least one mixing column and a first neighbouring surface of the elongated body define a plenum inlet therebetween adapted to receive the first flow of air.

3. The mixing plenum of claim 2, wherein the elongated body of the at least one mixing column and a second neighbouring surface of the elongated body define a plenum outlet therebetween adapted to exhaust one of a portion of the first flow of air, and the mixture of the first and second flows of air.

4. The mixing plenum of claim 3, wherein a surface area of the plenum outlet is greater than a surface area of the plenum inlet.

5. The mixing plenum of claim 3, wherein the at least one mixing column comprises a brim portion extending from a first end of the elongated body.

6. The mixing plenum of claim 5, wherein the at least one perforated surface and the brim portion define at least a portion of a second channel extending from the plenum inlet to the plenum outlet, the second channel being adapted to receive the first flow of air.

7. The mixing plenum of claim 1, wherein the at least one perforated surface is angled outwardly with respect to the flow direction of the first flow of air to define an acute angle with respect to the flow direction of the first flow of air.

8. The mixing plenum of claim 1, wherein the at least one perforated surface comprises a downstream portion defined at a distal end of the at least one perforated surface along the first flow of air, the downstream portion of the at least one perforated surface being devoid of perforations.

9. The mixing plenum of claim 1, wherein at least a portion of the mixing plenum is coated in a thermal insulating coating to maintain a temperature of the elongated body above a dew point of the first and second flows of air.

10. The mixing plenum of claim 9, wherein the thermal insulating coating comprises high-density polyethylene.

11. The mixing plenum of claim 1, wherein the at least one perforated surface defines a plurality of air flow perforations, and wherein a surface area of the respective air flow perforations increases along a flow direction of the second flow of air.

12. The mixing plenum of claim 1, wherein the mixing plenum defines a bypass conduit comprising a bypass inlet disposed in the first flow of air, the bypass conduit extending around the at least one mixing column and being configured to selectively receive the first flow of air.

13. The mixing plenum of claim 1, the mixing plenum further comprising a frame adapted to receive a plurality of mixing columns, the plurality of mixing columns being aligned in an adjacent configuration in a direction being normal to the flow direction of the first flow of air.

14. The mixing plenum of claim 1, wherein the elongated body comprises a closed end configured to restrict a flow of the second flow of air, the channel of the elongated body being configured to direct an entirety of the second flow of air to the at least one perforated surface.

15. The mixing plenum of claim 1, wherein the elongated body comprises a trapezoidal transverse cross-sectional shape.

16. A method of mixing first and second flows of air having different temperatures, the method comprising:

exposing an air-mixing column of an air-mixing plenum to the first flow of air, the first flow of air defining a first flow direction;

channeling the second flow of air through a channel extending through the air-mixing column along a longitudinal axis thereof;

channeling the first flow of air along a perforated surface of the air-mixing column, wherein the perforated surface of the air-mixing column is located within a first lateral wall or a second lateral wall of the air-mixing column, and wherein the perforated surface forms an angle with the first flow direction; and forming a pressure differential across the perforated surface to generate a mixture of the first and second flows of air.

17. The method of claim 16, further comprising exhausting the mixture of the first and second flows of air out of the air-mixing plenum in the first flow direction.

18. The method of claim 16, further comprising operating a damper to selectively regulate a volumetric flow rate of the second flow of air.

19. The method of claim 18, further comprising operating the damper to form a mixture ratio of the first and second flows of air comprising less than 20% of the second flow of air.

20. The method of claim 16, further comprising thermally insulating at least a portion of the air-mixing plenum to maintain a temperature of the surface of the air-mixing plenum above a dew point of the first and second flows of air.

* * * * *